US006715906B1

(12) United States Patent
Wu

(10) Patent No.: US 6,715,906 B1
(45) Date of Patent: Apr. 6, 2004

(54) DO-IT-YOURSELF PENDANT LAMP STRUCTURE

(76) Inventor: Wen-Chang Wu, No. 10, Lane 191, Hsi Hsin Street, Chang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 10/279,994

(22) Filed: Oct. 25, 2002

(51) Int. Cl.[7] ..... F21S 8/06

(52) U.S. Cl. ..... 362/405; 362/404; 362/406; 362/407; 362/408; 362/226

(58) Field of Search ..... 362/404, 405, 362/406, 407, 408, 226, 217, 457, 458; 439/339

(56) References Cited

U.S. PATENT DOCUMENTS

| | | | | | |
|---|---|---|---|---|---|
| 4,376,564 | A | * | 3/1983 | Kilbourne | 339/92 R |
| 5,526,251 | A | * | 6/1996 | Andre et al. | 362/396 |
| 5,568,969 | A | * | 10/1996 | Yu | 362/404 |
| 5,690,424 | A | * | 11/1997 | Warshauer et al. | 362/373 |
| 6,422,722 | B1 | * | 7/2002 | Voltolina | 362/405 |
| 6,536,927 | B1 | * | 3/2003 | Lawnicki | 362/448 |
| 6,565,240 | B1 | * | 5/2003 | Wu | 362/405 |

* cited by examiner

*Primary Examiner*—Thomas M. Sember
*Assistant Examiner*—Anabel Ton

(74) *Attorney, Agent, or Firm*—Troxell Law Office PLLC

(57) ABSTRACT

The present invention relates to a do-it-yourself (DIY) pendant lamp structure, comprising a fixed base and a connecting base, wherein the fixed base is hollow in its middle section, and comprises a cut opening on the side of a screw thread section at its top end; a female connector on the inner side of its bottom for supporting the electric wire; a restricting bracket coupled on both sides of the hollow section of the fixed base; a snap section protruding downward from the center of the restricting bracket such that the snap section slightly protrudes into the inner side of the hollow section of the fixed base for latching the snap section after the connecting section has passed through; a corresponsive male connector is disposed at the bottom of the connecting base; a latching bracket is protruded outward from the periphery corresponsive to the snap section of the fixed base and an aslant corner is inclined inward and downward from the bottom section of the latching bracket to align the latching bracket of the connecting base with the cut opening of the fixed base in advance and receive the insertion of the latching bracket into the fixed base, and the aslant corner of the connecting base exactly latches into the snap section of the restricting bracket to securely position the connecting base onto the fixed base; such arrangement not only can reduce the volume of the lamp structure for storage and transportation, but also provides a convenient DIY assembly for the user by simply inserting the connecting base into the fixed base.

2 Claims, 4 Drawing Sheets

DO-IT-YOURSELF PENDANT LAMP STRUCTURE

BACKGROUND OF THE INVENTION

1. Field of the Invention

A do-it-yourself (DIY) pendant lamp structure makes use of a hollow section at the middle section of a fixed base, a cut opening on the side of a screw thread section at the top of the fixed base, a restricting bracket coupled on both sides of the hollow section of the fixed base, a snap section protruding downward from the center of the restricting bracket such that the snap section slightly latches into the inner side of the hollow section of the fixed base, a latching bracket protruding outward from the periphery corresponsive to the snap section of the fixed base and an aslant corner is inclined inward and downward from the bottom section of the latching bracket to align the latching bracket of the connecting base with the cut opening of the fixed base in advance and accommodate the insertion of the latching bracket into the fixed base such that the aslant corner of the connecting base exactly latches into the snap section of the restricting bracket to reduce the volume of the lamp structure for storage and transportation.

2. Description of the Related Art

The connection between the body and the switch box of conventional pendant lamps is by "bolt and nut connection", but this kind of assembly by screws and nuts may easily collide the finished goods during the assembling, and has to use working tools such as wrench and screwdriver for the fixing. The friction produced during the assembling may expose the electric wire easily and may even cause the hazard of electric shock. Therefore, the traditional way causes trouble for the assembling, and is definitely not suitable for DIY users to assemble the lamp by themselves. The manufacturers have to assemble the whole set of pendant lamp first before selling the lamp, which may increase the cost. In view of these shortcomings, the inventor of the present invention based on years of experience accumulated from the engagement in the related industry conducted extensive research to resolve the aforementioned shortcomings and invented the present invention.

SUMMARY OF THE INVENTION

The primary objective of the present invention is to provide a do-it-yourself pendant lamp structure, comprising a fixed base and a connecting base, wherein the fixed base is hollow in its middle section, and comprises a cut opening on the side of a screw thread section at its top end; a female connector on the inner side of its bottom for supporting the electric wire; a restricting bracket coupled on both sides of the hollow section of the fixed base; a snap section protruding downward from the center of the restricting bracket such that the snap section slightly protrudes into the inner side of the hollow section of the fixed base for latching the snap section, in order to securely position the connecting base onto the fixed base.

The secondary objective of the present invention is to provide a do-it-yourself pendant lamp structure, of which the lamp rod of the connecting base can be unplugged from the fixed base in advance for packaging, transportation, or storage in order to reduce the volume for transportation and storage. Furthermore, when the user has bought the lamp home, the user just needs to insert the lamp rod into the fixed base for use and does not require bolts and nuts or other fixing tools, which provides a convenient DIY assembling for the user.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
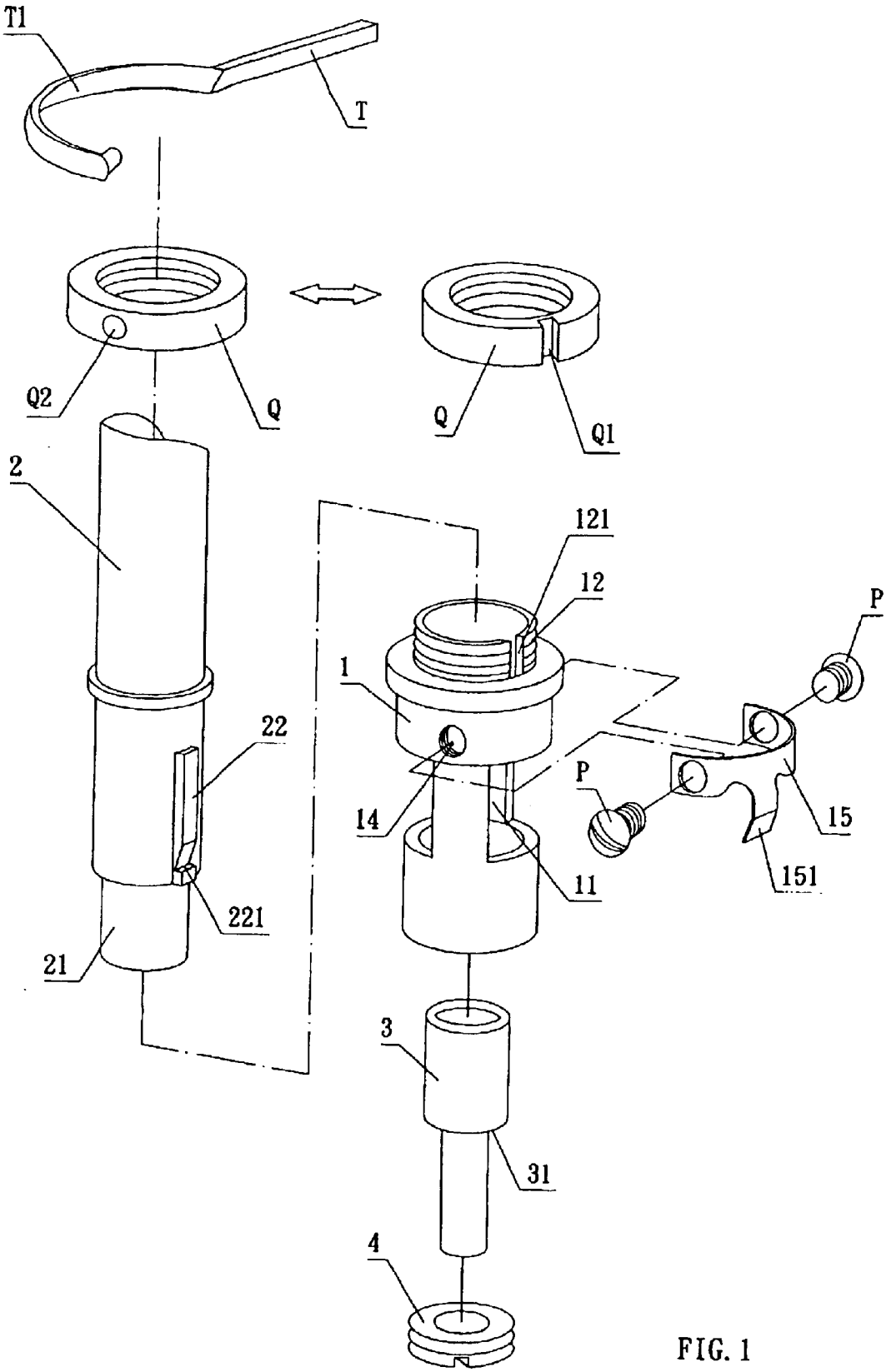
FIG. 1 is an explosive diagram showing the components of the present invention.
Figure 2:
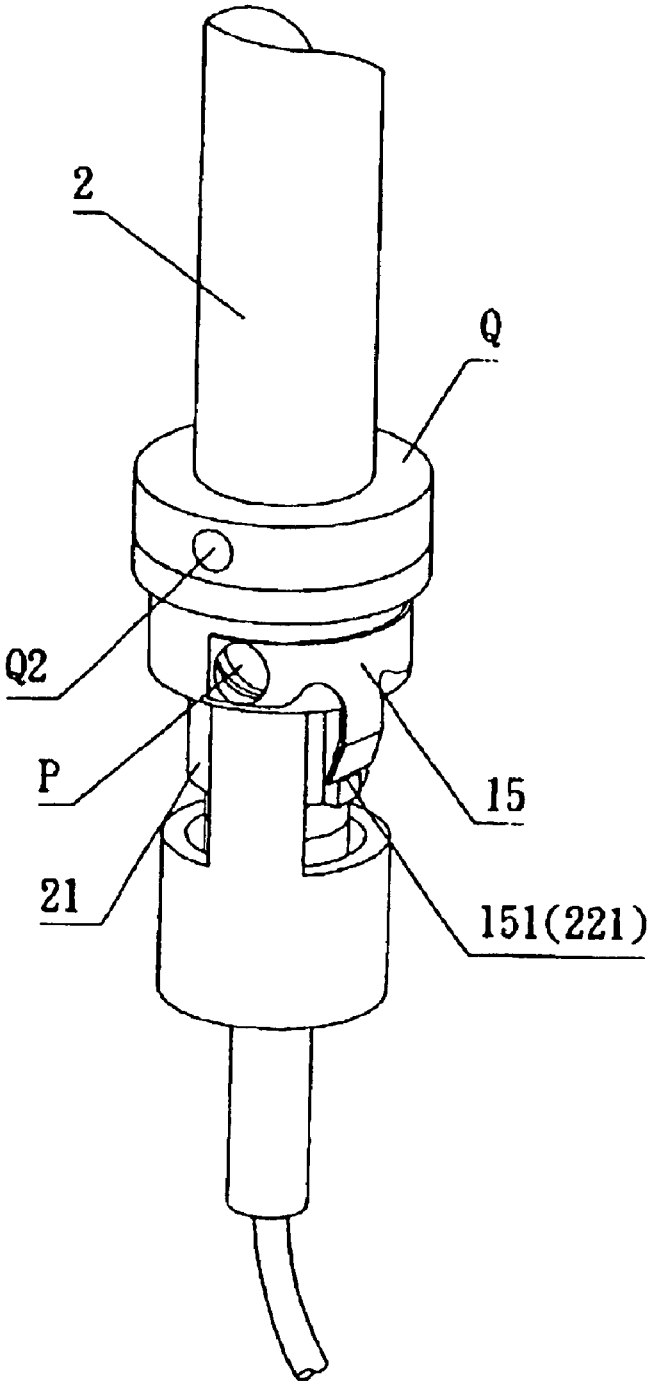
FIG. 2 is an assembled diagram of the present invention.

Please refer to FIGS. 1 and 2 for a clear understanding of the structure and mode of the present invention. The do-it-yourself pendant lamp structure of the present invention comprises a fixed base 1 coupled to a wire connection box D and disposed at an end of a lamp rod and a connecting section 2 connected to the fixed base 1, wherein the fixed base further comprises a hollow section 11 at the middle section enclosed by the sides of the fixed base 1; a screw thread section 12 at its top end of the fixed base 1; a cut opening 121 is disposed on a side of the thread section 12 for accommodating the connecting base 2; an inner screw thread section 13 on the inner side at the bottom of the fixed base 1 for receiving a female connector 3 with a stairway like edge 31; a rotary plug 4 is coupled at the bottom of the fixed base such that the rotary plug 4 can exactly block the lower section of the stairway-like edge 31 of the female connector 3. The female connector 3 can support the electric wire and prevent the wire from falling off.

A lock hole 14 is disposed separately on both sides of the hollow section 11 at the middle section of the fixed base 1; a positioning bracket 15 is coupled to lock hole 14 by a bolt P, and a snap section 151 is protruded downward from the center of the restricting bracket 15, such that the snap section is slightly extended into the hollow section 11 of the fixed base 1 to latch the connecting base 2 onto snap section 151 of the restricting plate restricting.

A male connector 21 is disposed at the bottom of the connecting base 2, and a latching bracket 22 is extended outward from the periphery of the connecting base 2 corresponsive to a position of the snap section 151 of the fixed base, and an aslant corner 221 inclined downward from the bottom of the latching bracket 22 to align the latching bracket 22 of the connecting base 2 with the cut opening 221 of the fixed base 1 in advance in order to insert the connecting base 2 into the fixed base 1.

Figures 3A, 3B, 3C:
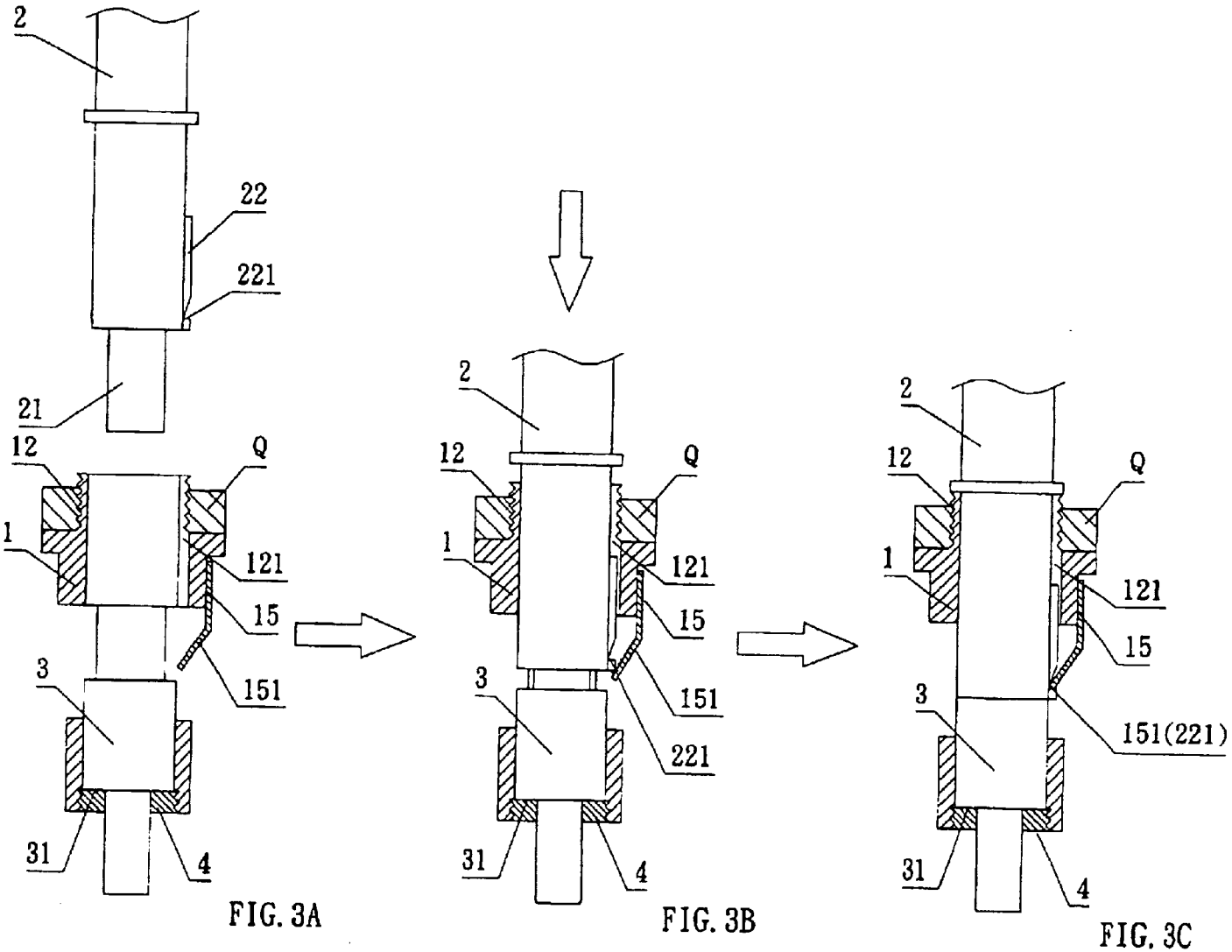
FIG. 3A is a cross-sectional diagram showing the connection of bolts and nuts according to the present invention.
FIG. 3B is a cross-sectional diagram of the pendant lamp of the present invention before assembling.
FIG. 3C is a cross-sectional diagram of the pendant lamp of the present invention after assembling.
Figure 4:
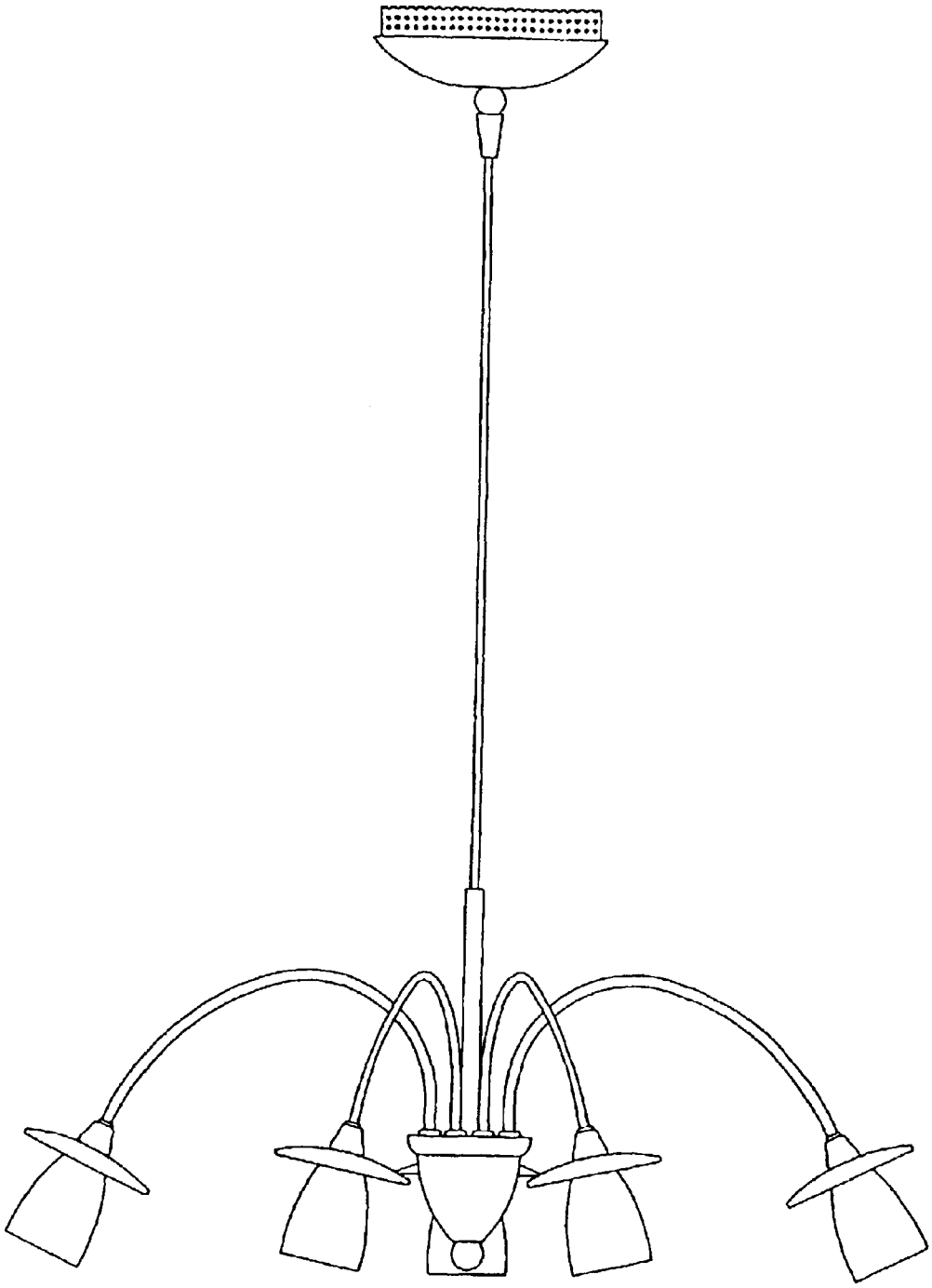
FIG. 4 is a diagram of the pendant lamp of a preferred embodiment of the present invention.

Please refer to FIGS. 3A to 3C and 4 for the motion and assembly. The screw nut Q is fixed to the screw thread section 12 from the top of the fixed base 1 in order to securely position the connecting base 2 to the wire connection box (as shown in FIG. 3A), and the latching bracket 22 of the connecting base 2 is aligned with and inserted into the cut opening 121 so that the latching bracket 22 of the connecting base 2 drives the snap section 151 of the restricting bracket 15 outward first (as shown in FIG. 3B). After the male connector 21 of the connecting base 2 is fully inserted into the female connector at the bottom of the fixed base 1, the aslant corner 221 of the connecting base 2 is latched exactly into the snap section 151 of the restricting bracket 15 (as shown in FIG. 3C). The screw nut Q has an embedded groove Q1, Q2 at its periphery for rotating the screw nut Q by means of the connecting section T1 of the hand tool T to prevent scratches the surface of the screw nut Q.

The lamp rod with the connecting base 2 of the pendant lamp can be unplugged from the fixed base 1 in advance for packaging, transportation, or storage to reduce the volume for transportation and storage. Furthermore, when the user has bought the lamp home, the user just needs to insert the lamp rod into the fixed base 1 for use, and it requires no screw bolts, nuts, or tools for the fixing. Such arrangement provides a convenient DIY assembling for users.

In summation of the above description, the do-it-yourself pendant lamp structure of the present invention herein enhances the performance over the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A do-it-yourself pendant lamp structure, comprising a fixed base coupled to a wire connection box and a connecting base disposed at an end of a lamp rod and inserted into the fixed base; wherein:

the fixed base, having a hollow section its middle section, and a cut opening on the side of a screw thread section at its top end for receiving the connecting base; a screw thread section being disposed on the inner side of the fixed base, and after a female connector being inserted, a rotary plug being coupled to the bottom of the fixed base for supporting female connector and the electric wire; a restricting bracket being coupled on both sides of the hollow section of the fixed base; a snap section protruding downward from the center of the restricting bracket such that the snap section slightly protrudes into the inner side of the hollow section of the fixed base for latching the snap section after the connecting section has passed through; a corresponsive male connector being disposed at the bottom of the connecting base; a latching bracket being protruded outward from the periphery corresponsive to the snap section of the fixed base; an aslant corner being inclined inward and downward from the bottom section of the latching bracket to align the latching bracket of the connecting base with the cut opening of the fixed base in advance and receive the insertion of the latching bracket into the fixed base, and the aslant corner of the connecting base exactly latches into the snap section of the restricting bracket to securely position the connecting base onto the fixed base; such arrangement not only can reduce the volume of the lamp structure for storage and transportation, but also provides a convenient DIY assembly for the user by simply inserting the connecting base into the fixed base.

2. A do-it-yourself pendant lamp structure as claimed in claim 1, wherein said connecting base with its top end being coupled to the screw thread section at the top of the fixed base by means of a screw nut, so that the connecting section is securely positioned onto the fixed base and a latching groove disposed on the periphery of the screw nut drives the screw nut to rotate to avoid scratches to the surface of the screw nut after being latched by a latch section of a hand tool.

* * * * *